US007804464B2

(12) United States Patent
Gonzalez et al.

(10) Patent No.: US 7,804,464 B2
(45) Date of Patent: Sep. 28, 2010

(54) ADJUSTABLE PANELING SYSTEM FOR A PHASING STRUCTURE

(75) Inventors: Dino C. Gonzalez, Thousand Oaks, CA (US); Daniel G. Gonzalez, Topanga, CA (US); Leslie E. Oliver, Thousand Oaks, CA (US)

(73) Assignee: Communications & Power Industries, Inc., Palo Alto, CA (US)

( * ) Notice: Subject to any disclaimer, the term of this patent is extended or adjusted under 35 U.S.C. 154(b) by 92 days.

(21) Appl. No.: 11/933,063

(22) Filed: Oct. 31, 2007

(65) Prior Publication Data

US 2009/0109119 A1 Apr. 30, 2009

(51) Int. Cl.
*H01Q 15/20* (2006.01)

(52) U.S. Cl. ..... 343/915; 343/912; 343/878; 343/880

(58) Field of Classification Search ..... 34/912, 34/915, 878, 880
See application file for complete search history.

(56) References Cited

U.S. PATENT DOCUMENTS

| | | | | |
|---|---|---|---|---|
| 3,401,390 | A * | 9/1968 | Braccini et al. | 343/915 |
| 4,750,002 | A * | 6/1988 | Kommineni | 343/915 |
| 4,905,014 | A * | 2/1990 | Gonzalez et al. | 343/909 |
| 6,198,457 | B1 * | 3/2001 | Walker et al. | 343/840 |
| 2004/0085255 | A1 * | 5/2004 | Sugiyama | 343/916 |
| 2005/0003873 | A1 * | 1/2005 | Naidu et al. | 455/575.7 |

* cited by examiner

*Primary Examiner*—Douglas W Owens
*Assistant Examiner*—Dieu Hien T Duong
(74) *Attorney, Agent, or Firm*—Hoffmann & Baron, LLP

(57) ABSTRACT

A phasing structure includes a support matrix for a reflective surface which reflects microwaves within an operation frequency band. The reflective surface includes a plurality of adjustable sub-panels. In one embodiment, the phasing structure may include a phasing arrangement of electromagnetically-loading structures supported by the support matrix. The sub-panels may be secured to the support matrix and individually adjustable using a securing means which, in one embodiment, includes one or more differential bolts.

18 Claims, 3 Drawing Sheets

ADJUSTABLE PANELING SYSTEM FOR A PHASING STRUCTURE

1. FIELD OF THE INVENTION

The present invention relates in general to reflecting and focusing electromagnetic radiation, and more particularly to an adjustable phasing structure configured to electromagnetically emulate a desired reflective surface of selected geometry over an operating frequency band.

2. BACKGROUND

In modern antenna and communication systems, reflective surfaces have been designed with specific geometries over specific operating frequency bands. In general, microwave structures include a support matrix and reflective means for reflecting microwaves within the operating frequency band. Substantially planar surfaces have been utilized to reflect incident electromagnetic waves within a operating frequency band. Reflective surfaces have also been provided with parabolic surfaces to provide a parabolic reflector.

The use of curved reflective surfaces of any geometry to be emulated electromagnetically using a substantially planar microwave reflector antenna configuration, has been suggested. U.S. Pat. No. 4,905,014 issued to Gonzalez et al., Feb. 27, 1990, the contents of which are fully incorporated herein by reference, teaches a phasing structure emulating desired reflective surfaces regardless of the geometry of the physical surfaces to which the microwave phasing structure is made to conform, wherein the structure may be fabricated as a fraction of the wavelength of the operating frequency of the phasing surface. The aforementioned technology, marketed as Flat Parabolic Surface (FLAPS™) technology accomplishes the aforementioned function using a dipole antenna placed in front of a ground plane. However, due to operational frequencies of the antenna, the precision required for the phasing structures requires very high levels of precision that are hard to obtain.

A low-windload structure has been suggested to provide another version of FLAPS technology. U.S. Pat. No. 6,198,457, issued to Walker et al., Mar. 6, 2001, teaches a low-windload phasing structure including FLAPS technology, the contents of which are fully incorporated herein by reference. However, even utilizing a low-windload version of the structure, it is extremely difficult to obtain the flatness required for high operational frequencies.

The geometry of antenna structures may be based on operation frequency. The wavelength of an antenna, $\lambda$, depends on the operational frequency of the antenna, such that:

$$\lambda = c/f$$

Where, $\lambda$=wavelength;

c=speed of light; and f=frequency.

Thus, at low frequencies, $\lambda$ is longer and at high frequencies, $\lambda$ is shorter. For a reflector antenna to provide efficient operation, the surface tolerances requirements are typically on the order of $\lambda/32$ to $\lambda/100$. Thus, the antenna must be fabricated to a flatness of strict precision. That is, when $\lambda$ is very small, it is very difficult to obtain the precision needed. For example, at f=94 GHz, $\lambda$ is approximately 0.125 inches. With $\lambda/100$ accuracy, there is a tolerance of 0.00125". Therefore, an 8'×8' antenna would require a tolerance of 1/1000th of an inch for flatness. This so-called "super precision" is extremely difficult to achieve.

While conventional antenna structures teach phasing antennas of multiple geometries and different surfaces, such systems struggle to satisfy the super precise flatness requirement demanded by high operational frequencies. Accordingly, there is a need in the art to provide a phasing structure which overcomes the aforementioned drawback.

BRIEF SUMMARY OF THE INVENTION

Disclosed and claimed herein is a microwave phasing structure configured to electromagnetically emulate a desired reflective surface of selected geometry over an operating frequency band. In one embodiment, the microwave phasing structure includes a support matrix, a plurality of adjustable sub-panels coupled to the support matrix and forming a reflective surface for reflecting microwaves within an operation frequency band, and a securing means for securing said plurality of adjustable sub-panels to said support matrix, and for individually adjusting a position of each of the plurality of adjustable sub-panels.

Other aspects, features, and techniques of the invention will be apparent to one skilled in the relevant art in view of the following description of the exemplary embodiments of the invention.

DETAILED DESCRIPTION OF EXEMPLARY EMBODIMENTS

Figure 1A:
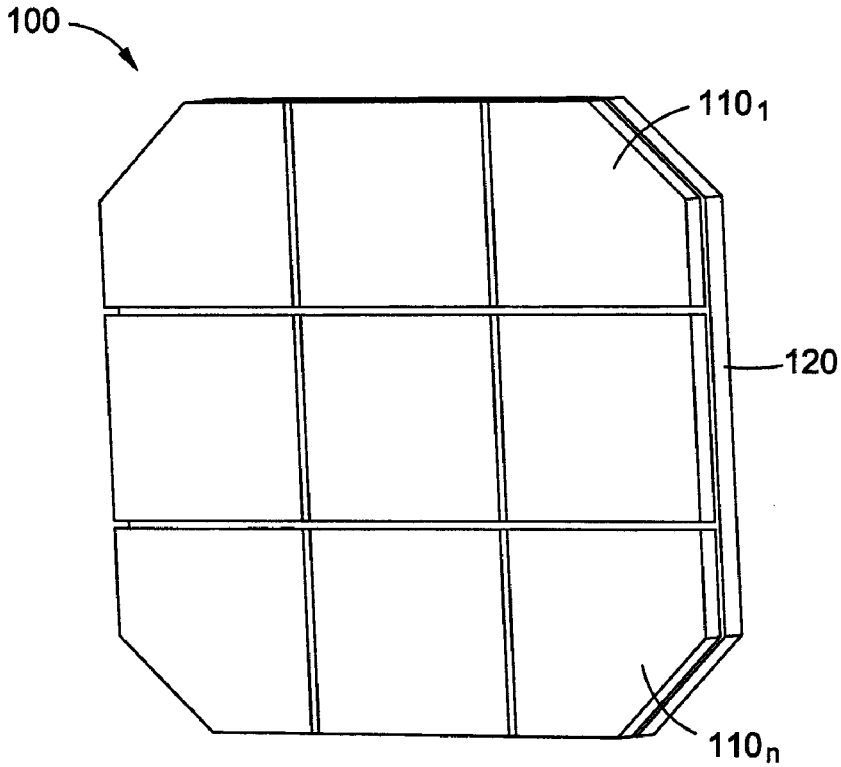
FIGS. 1A-1E depicts a phasing structure according to one or more embodiments of the invention.

One aspect of the invention is to provide a phasing structure comprised of a plurality of sub-panels, such that the plurality of the sub-panels as a whole may emulate a desired reflective surface. According to another embodiment of the invention, curved (e.g., parabolic) reflective surfaces using physical antenna configurations may be obtained using a plurality of sub-panels, thereby facilitating the installation of reflector antennas where space and weight limitations, or where physical conditions (e.g., turbulent air flow) would otherwise prevent such installations, or render it highly undesirable to do so. According to another embodiment of the invention, a phasing structure may be provided having a plurality of sub-panels such that the phasing structure may be fabricated as a fraction of the wavelength of the operating frequency of the phasing surface.

In another embodiment of the invention, a phasing structure may include means for positioning a sub-panel of the phasing structure. In order to obtain efficient operation of a phasing structure, the sub-panel may be adjusted such that the phasing structure conforms to a degree of flatness.

In one embodiment of the invention, a sub-panel may be adjusted by its securing means. That is, a sub-panel may be secured to the aforementioned support matrix such that the sub-panel is adjustable with respect to the support matrix. It may further be appreciated that a sub-panel may be removable from said support matrix. Such securing and/or adjusting may be performed using, for example, a plurality of differential bolts.

A high-precision surface tolerance may be achieved with the use of the aforementioned sub-panels. In certain embodiments, individually adjustable sub-panels may be used to satisfy the super precise flatness requirement demanded by high operational frequencies. Additionally, fabrication of the phasing structure may be facilitated through the use of sub-paneling, as would be repairing damaged reflectors since only individual sub-panels would need to be replaced. That is, in the event of physical damage to the phasing structure, a damaged sub-panel may be removed and replaced with a second sub-panel to meet surface requirements of the phasing structure.

Finally, another aspect of the invention is to focus the incident electromagnetic waves (within the operating frequency band of the microwave phasing structure) using a substantially planar ultra-thin structure, where path lengths of the incident electromagnetic waves to the focal point of the focusing element are electronically phase equalized without requiring the use of a conventional dielectric lens for path length compensation.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Reference throughout this document to "one embodiment", "certain embodiments", "an embodiment" or similar term means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner on one or more embodiments without limitation. Therefore, "A, B or C" means any of the following: A; B; C; A and B; A and C; B and C; A, B and C. An exception to this definition will occur only when a combination of elements, functions, steps or acts are in some way inherently mutually exclusive.

Figure 1B:
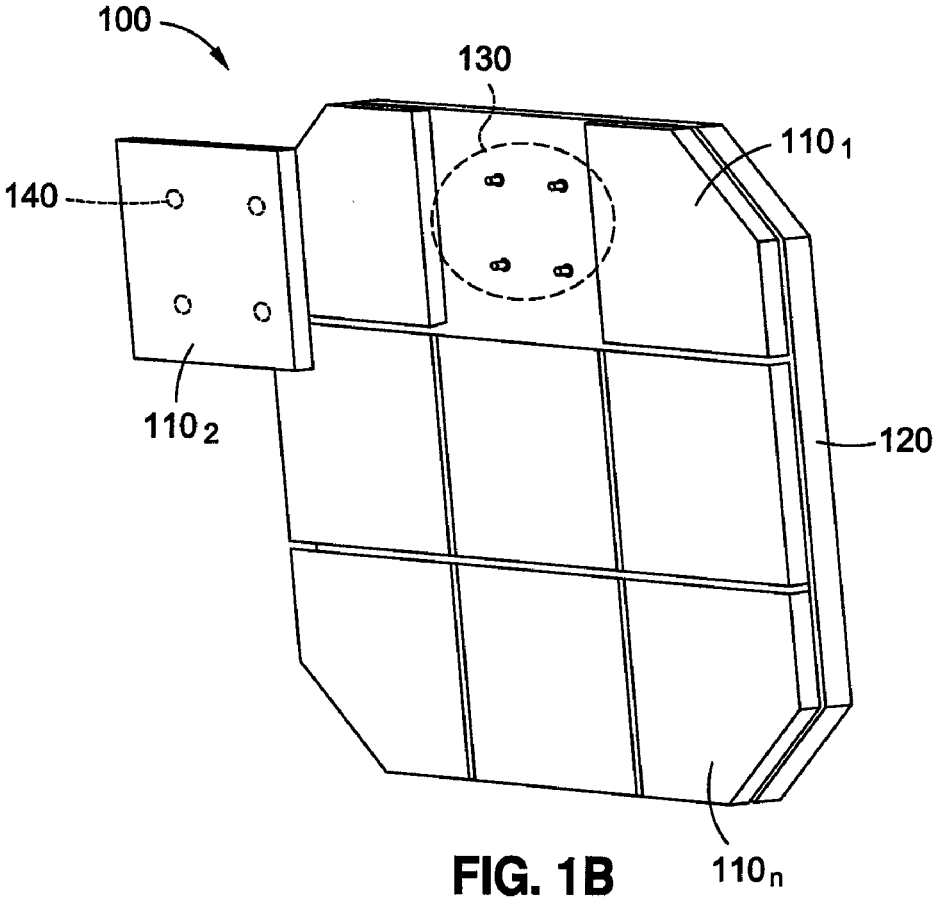

Referring now to FIGS. 1A-1B, depicted is one embodiment of a phasing structure 100 configured in accordance with the principles of the invention. Namely, phasing structure 100 is configured as a planar phasing structure and comprised of a plurality of sub-panels $\mathbf{110}_1$-$\mathbf{110}_n$, which collectively make up a reflective surface for the phasing structure 100. As shown, the plurality of sub-panels $\mathbf{110}_1$-$\mathbf{110}_n$ are depicted with a generally rectangular shape, while the corner sub-panels are slightly modified to account for the cut-off corner design of the phasing structure 100. However, it should of course be appreciated that the sub-panels $\mathbf{110}_1$-$\mathbf{110}_n$ may be configured in any number of shapes and/or sizes based on, in part, the desired phasing response. Although not shown, in certain embodiments the sub-panels $\mathbf{110}_1$-$\mathbf{110}_n$ may include one or more hash marks, color-code indicators and/or leveling indicators to provide an indication of the orientation of the various sub-panels $\mathbf{110}_1$-$\mathbf{110}_n$. In certain embodiments, these indicators may function to facilitate the assembly of the phasing structure 100.

In addition, the sub-panels $\mathbf{110}_1$-$\mathbf{110}_n$ may be comprised of a metallic layer capable of reflecting microwaves within the desired operating frequency band of the phasing structure 100 hereof, but may reflect other frequencies as well without undesirable consequences.

In still another embodiment, the sub-panels $\mathbf{110}_1$-$\mathbf{110}_n$ may comprise individual "electrically thin" microwave phasing panels fabricated as thin as a fraction of the wavelength of the operating frequency of the phasing surface according to one aspect of the invention. In one embodiment, such electrically thin phasing panels may provide electromagnetic emulation of a desired reflective surfaces regardless of the geometry of the physical surfaces to which the electrically thin microwave phasing structure is made to conform. As used hereinafter, the term "electrically thin" shall mean on the order of a fraction of the wavelength of the operating frequency of the microwave phasing structure.

Incident electromagnetic waves transmitted from a source located far away may be focused to a focal point near the phasing structure 100, such that a detector of a receiver may detect an incident wave without the internal installation of a parabolic reflector antenna.

In accordance with yet another embodiment of the present invention, the phasing structure 100 may be mounted to a pedestal (not shown), wherein the pedestal has a base for mounting to a surface. The phasing structure 100 may be mounted to the opposite end of the pedestal by means of a steering platform capable of aiming the reflector at a desired direction. According to another aspect of the invention, the sub-panels $\mathbf{110}_1$-$\mathbf{110}_n$ may be directly connected to each other to provide a phasing structure.

Continuing to refer to FIG. 1A, the sub-panels $\mathbf{110}_1$-$\mathbf{110}_n$ are disposed on a support structure or matrix 120. In certain embodiments, the support matrix may comprise a dielectric substrate or other suitable insulative or dielectric material, such as Teflon™. However, it should be appreciated that the support matrix 120 may be any structure capable of supporting the sub-panels $\mathbf{110}_1$-$\mathbf{110}_n$. The support matrix 120 may further be comprised of multiple layers.

Although not shown in FIG. 1A, the sub-panels $\mathbf{110}_1$-$\mathbf{110}_n$ may further have an arrangement of electromagnetically-loading structures disposed thereon to emulate a desired reflective geometry. Such electromagnetically-loading structures may vary in dimension, having an orientation and interspacing from each other. In certain embodiments, such electromagnetically-loading structures may correspond to the electromagnetically-loading structures disclosed in the previously-incorporated U.S. Pat. No. 4,905,014, the details of which are fully disclosed therein. By way of example, the arrangement of electromagnetically-loading structures may comprise an array of metallic patterns, where each metallic pattern has a cross (i.e., X) configuration with dimensions, orientation, and interspacing such that the desired reflective surface, of selected geometry is obtained. Each metallic pattern may constitute a shorted crossed dipole.

Referring now to FIG. 1B, depicted is an expanded view of the phasing structure 100 in which one sub-panel $\mathbf{110}_2$ has been removed to reveal the securing means 130 for the particular sub-panel $\mathbf{110}_2$. While in one embodiment, the securing means 130 may be in the form of differential bolts which pass through the support matrix 120 and into the sub-panel $\mathbf{110}_2$, numerous other embodiments would be consistent with the invention and within the scope of this disclosure. By way of example, the securing means 130 may function to secure the sub-panel $\mathbf{110}_2$ by fitting within corresponding recesses 140 oriented on the backside of the sub-panel $\mathbf{110}_2$. While the details of how the sub-panel $\mathbf{110}_2$ may be secured to the support matrix 120 may vary, in one embodiment the securing means may form a snug-fit within the recesses 140 of the sub-panel $\mathbf{110}_2$. Alternatively, the recesses 140 may be threaded such that that the securing means (e.g., differential bolts) may thread through the support matrix 120 and into the recesses 140 on the backside of the sub-panel $\mathbf{110}_2$. In another embodiment, when the securing means 130 functions to adjust sub-panel $\mathbf{110}_2$ it may be alternatively be in the form of one or more pistons, hydraulic actuators and mechanical actuators.

Regardless of how the sub-panel $\mathbf{110}_2$ is held place, one aspect of the invention is to enable the sub-panels, including sub-panel $\mathbf{110}_2$, to be adjusted so as to achieve a highly precise degree of flatness for the phasing structure 100. To that end, securing means 130 may further serve to adjust the orientation of the sub-panel $\mathbf{110}_2$ with respect to the support matrix 120 by enabling the distance between the sub-panel $\mathbf{110}_2$ and the support matrix 120 to be adjusted with one or more degrees of freedom. By way of example, FIG. 1B includes four individually adjustable securing means 130 (e.g., differential bolts) corresponding to the four corners of the sub-panel $\mathbf{110}_2$. In this fashion, each corner of the sub-panel $\mathbf{110}_2$ may be individually adjusted. It should of course be appreciated that more or fewer securing means 130 may be used to secure and/or adjust the various sub-panels $\mathbf{110}_1$-$\mathbf{110}_n$. Typically, the greater the number of securing means 130, the greater the number of degrees of freedom for adjustment.

According to another embodiment of the invention, the plurality of sub-panels $\mathbf{110}_1$-$\mathbf{110}_n$ may be configured such that edges of the panels are securely attached to each other so as to provide the reflective panel or surface. In another embodiment, sub-panels may be attached to a support matrix to provide a phasing structure. In one embodiment of the invention, panels may be assembled through one or more of manual assembly and automatic assembly. Panels may have indicators to aid in the assembly of the phasing structure. Indicators may provide one or more of connection of the sub-panels and orientation of the sub-panels in the phasing structure.

Figure 1C:
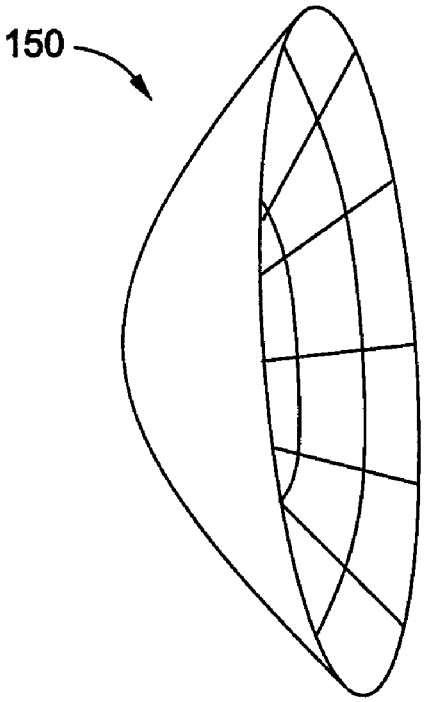
Figure 1D:
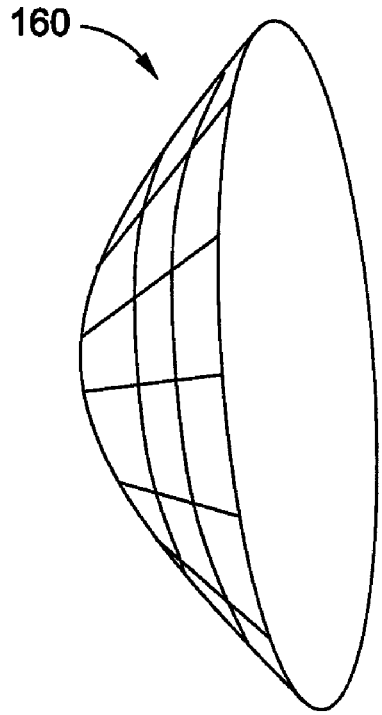
Figure 1E:
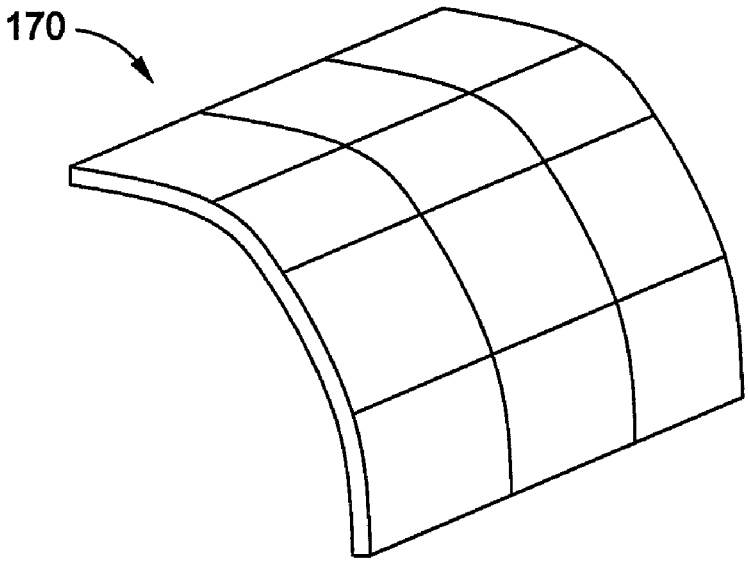

Although the phasing structure 100 is depicted as being planar, it may similarly have numerous other configurations. To that end, FIGS. 1C-1E correspond to other configurations for the phasing structure 100 of FIGS. 1A-1B. In particular, FIG. 1C depicts a concave parabolic phasing structure 150 having a plurality of sub-panels, while FIG. 1D depicts a convex embodiment of a parabolic phasing structure 160 also comprised of a plurality of sub-panels. Finally, FIG. 1E is a curved phasing structure 170 also including a series of sub-panels in accordance with the principles of the invention.

In another embodiments, the phasing structure of the invention may be a low windload structure, such as the phasing structure disclosed in previously-incorporated U.S. Pat. No. 6,198,457.

Figure 2:
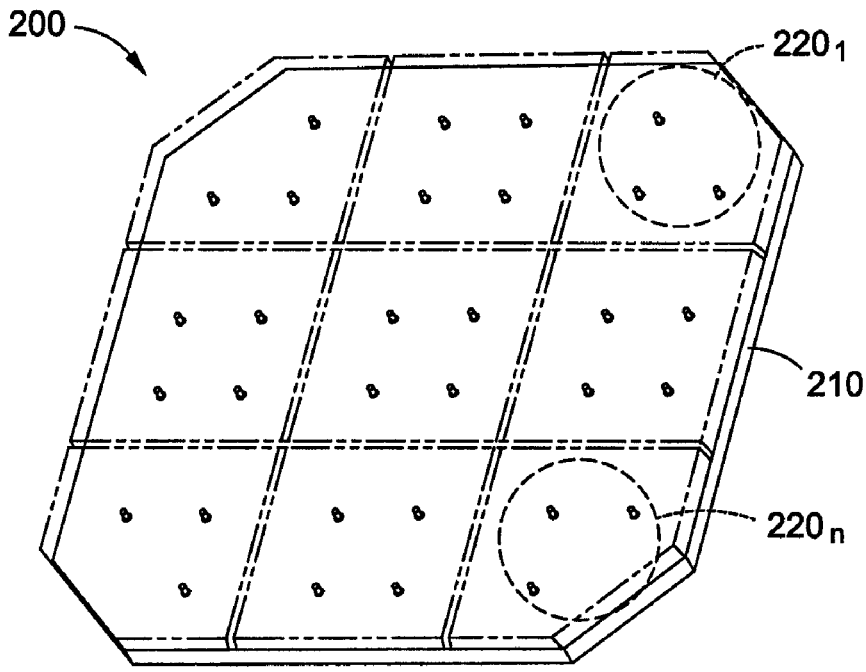
FIG. 2 depicts one embodiment of the support matrix for the phasing structure of FIGS. 1A-1B.

Referring now to FIG. 2, depicted is one embodiment of a phasing structure 200 in which its sub-panels have been removed to reveal the underlying support structure or matrix 210. Although the sub-panels have been removed for illustrative purposes, the fixed-in-place position of the sub-panels is represented by the dashed-lines in FIG. 2. When assembled, the phasing structure 200 of FIG. 2 may be used to emulate a desired reflective surface.

FIG. 2 shows how a set of securing means $\mathbf{220}_1$-$\mathbf{220}_n$ may be used to secure each of the sub-panels of the phasing structure 200. It should further be appreciated that more or fewer number of securing means within each set of securing means $\mathbf{220}_1$-$\mathbf{220}_n$ may be used. In this fashion, individual sub-panels may be secured and/or adjusted in one or more degrees of freedom. As previously mentioned, the ability to adjust individual sub-panels, as provided for in one or more embodiments of the invention, may be used to satisfy the super precise flatness requirement of the phasing structure 200 demanded by high operational frequencies.

Each set of securing means $\mathbf{220}_1$-$\mathbf{220}_n$ may correspond to a plurality of differential bolts usable for coupling a sub-panel to support matrix 210. In one embodiment of the invention, securing means $\mathbf{220}_1$-$\mathbf{220}_n$ may provide a locking mechanism to prevent movement of a sub panel. In addition, the securing means $\mathbf{220}_1$-$\mathbf{220}_n$ may also function as adjustment means in the manner described above with reference to FIGS. 1A-1B. According to another aspect of the invention, sub-panels may provide a phasing arrangement of electromagnetically-loading structures supported on said support matrix 210.

The support matrix 210 may be in the form of a frame or a panel constructed of, for example, a carbon epoxy panel. It should of course be appreciated that any other materials capable of functioning as a support for sub-panels of the invention may be similarly used.

In another embodiment of the invention, the support matrix 210 may include an outer frame assembly (not shown). This frame assembly may include a plurality of radially extending spaced apart support arms extending to an outer periphery of the panel as well as annular axial support members attached thereto. In one embodiment of the invention, a panel may include a grid-like support structure mounted within the frame assembly. In another embodiment, the support arms and axial support members may provide a sub-frame in which a grid-like support structure is provided. The grid-like support structure may have apertures such that grid intersections are spaced up to about $\lambda/2$ wavelength apart, where $\lambda$ may be a desired wavelength of energy to be received by the antenna. Reflective radiators may be arranged and mounted to the support assembly for reflecting a desired wavelength to a focal point of a reflector. According to another aspect of the invention, a feed assembly may be provided at the focal point of the assembly for one or more of receiving and transmitting energy at the desired frequency.

Figure 3A:
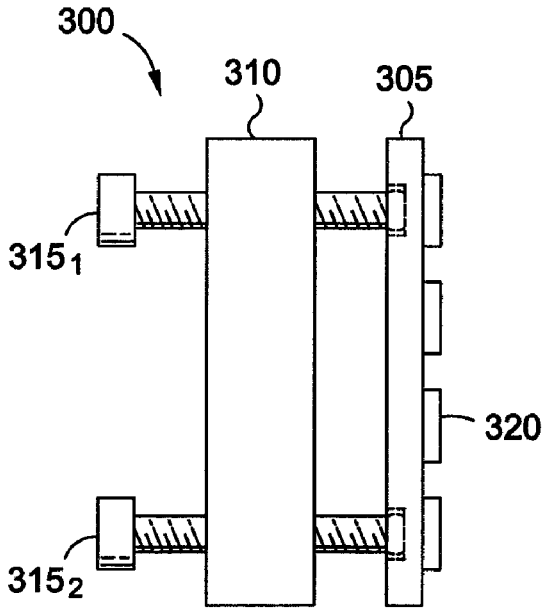
FIGS. 3A-3B depicts a side view of one embodiment of the phasing structure of FIGS. 1A-1B.
Figure 3B:
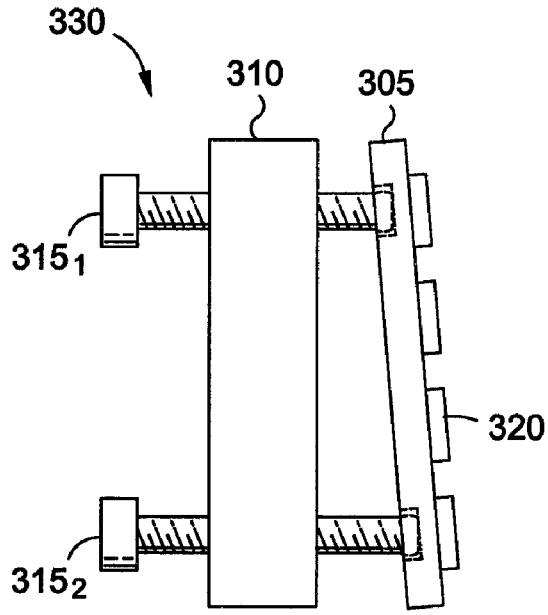

Referring now to FIGS. 3A-B, a phasing structure side-view is depicted according to one or more aspects of the invention. Referring first to FIG. 3A, a side view of a phasing structure 300 is depicted as including a sub-panel 305 coupled to support structure 310. As shown, the phasing structure 300 includes differential bolts $\mathbf{315}_1$-$\mathbf{315}_2$ to couple the sub-panel 305 to the support structure 310. In addition, differential bolts $\mathbf{315}_1$-$\mathbf{315}_2$ may provide differential adjustment of the sub-panel 305. As also shown in FIG. 3A, the phasing structure 300 further includes dipole elements 320 which may function as electromagnetically-loading structures to emulate a desired reflective geometry. The electromagnetically-loading structures of dipole elements 320 may vary in dimension, having an orientation and interspacing from each other. According to another aspect of the invention, electromagnetically-loading structures may be disposed at a distance from the reflective surface by the support matrix 310.

While only two differential bolts $\mathbf{315}_1$-$\mathbf{315}_2$ are depicted, it should equally be appreciated that additional bolts may be used. Also, while each differential bolt $\mathbf{315}_1$-$\mathbf{315}_2$ is depicted as being situated in a recess on a backside of the sub-panel 305, other configurations for securing and/or adjusting the sub-panel 305 should be considered within the scope of this disclosure. FIG. 3B depicts a phasing structure 330 of FIG. 3A after differential bolt $\mathbf{315}_1$ has been used to place the sub-panel 305 in an adjusted position.

In a preferred embodiment, the differential bolts $\mathbf{315}_1$-$\mathbf{315}_2$ provide a high degree of adjustment. The differential bolts $\mathbf{315}_1$-$\mathbf{315}_2$ may provide a turning ratio that is a fraction of the conventional ratio of 33 turns per inch with 1/32 of conventional fasteners. The differential bolts $\mathbf{315}_1$-$\mathbf{315}_2$ may provide a turn ratio of 1/300 which may provide high precision adjustment of a sub-panel. According to another embodiment of the invention, the panels may be secured and/or adjusted using, for example, one or more pistons, hydraulic actuators and mechanical actuators.

While the invention has been described in connection with various embodiments, it should be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. A microwave phasing structure comprising:

a support structure;

a plurality of adjustable sub-panels coupled to the support structure and forming a reflective surface for reflecting microwaves within an operation frequency band; and a securing means for securing said plurality of adjustable sub-panels to said support structure and for individually adjusting a position of at least one of the plurality of adjustable sub-panels, said securing means comprising a plurality of differential bolts for securing and differentially adjusting the plurality of sub-panels such that a distance between the support structure and corners of at least one of the plurality of sub-panels can be individually adjusted with at least one degree of freedom, thereby enabling the at least one sub-panel to be tilted with respect to the support structure, the support structure to which the plurality of adjustable sub-panels are coupled comprising a flat planar surface extending continuously under each of the plurality of adjustable sub-panels.

2. The microwave phasing structure of claim 1, further comprising a plurality of electromagnetically-loading structures configured to emulate a desired reflective geometry and disposed on at least one of the plurality of adjustable sub-panels.

3. The microwave phasing structure of claim 1, wherein said reflective surface is selected from the list consisting of a parabolic surface and a curved surface.

4. The microwave phasing structure of claim 1, wherein the plurality of sub-panels further comprises a plurality of recesses oriented on a side opposite to the reflective surface, wherein said plurality of recesses are configured to receive the securing means, as least one of said plurality of recesses extending only partially through the sub-panel.

5. The microwave phasing structure of claim 1, wherein at least one of said plurality of sub-panels further comprises a leveling indicator disposed thereon that is configured to provide an indication of orientation of at least one of said plurality of sub-panels.

6. The microwave phasing structure of claim 5, wherein said indicator comprises one or more of a plurality of hash marks, a color code indicator and a leveling indicator.

7. The microwave phasing structure of claim 1, wherein said support structure further comprises a ground plane.

8. The microwave phasing structure of claim 1, wherein said microwave phasing structure is configured to be resonant at a frequency outside of said operating frequency band.

9. The microwave phasing structure of claim 1, wherein each of the securing means on any of the plurality of adjustable sub-panels is equally spaced apart from at least two other securing means on the same adjustable sub-panel.

10. A microwave phasing structure comprising:

a support structure;

a plurality of adjustable sub-panels coupled to the support structure and forming a reflective surface for reflecting microwaves within an operation frequency band;

a phasing arrangement of electromagnetically-loading structures disposed on one or more of the plurality of adjustable sub-panels; and a plurality of actuators each coupled to the support structure and to one of the plurality of adjustable sub-panels, said plurality of actuators being configured to individually adjust a position of at least one of the plurality of adjustable sub-panels, said plurality of actuators comprising securing means comprising a plurality of differential bolts for securing and differentially adjusting the plurality of sub-panels such that a distance between the support structure and corners of at least one of the plurality of sub-panels can be individually adjusted with at least one degree of freedom, thereby enabling the at least one sub-panel to be tilted with respect to the support structure, the support structure to which the plurality of adjustable sub-panels are coupled comprising a flat planar surface extending continuously under each of the plurality of adjustable sub-panels.

11. The microwave phasing structure of claim 10, wherein the phasing arrangement of electromagnetically-loading structures is configured to emulate a desired reflective geometry.

12. The microwave phasing structure of claim 10, wherein said reflective surface is selected from the list consisting of a parabolic surface and a curved surface.

13. The microwave phasing structure of claim 10, wherein the plurality of sub-panels further comprises a plurality of recesses oriented on a side opposite to the reflective surface, wherein said plurality of recesses are configured to receive the securing means, as least one of said plurality of recesses extending only partially through the sub-panel.

14. The microwave phasing structure of claim 10, wherein each of said plurality of sub-panels further comprises a leveling indicator disposed thereon that is configured to provide an indication of orientation of at least one of said plurality of sub-panels.

15. The microwave phasing structure of claim 14, wherein said indicator comprises one or more of a plurality of hash marks, a color code indicator and a leveling indicator.

16. The microwave phasing structure of claim 10, wherein said support structure further comprises a ground plane.

17. The microwave phasing structure of claim 10, wherein said phasing arrangement is configured to be resonant at a frequency outside of said operating frequency band.

18. The microwave phasing structure of claim 10, wherein each of the securing means on any of the plurality of adjustable sub-panels is equally spaced apart from at least two other securing means on the same adjustable sub-panel.

* * * * *